US008823471B2

(12) United States Patent
Stanec et al.

(10) Patent No.: US 8,823,471 B2
(45) Date of Patent: Sep. 2, 2014

(54) WAVEGUIDE BACKSHORT ELECTRICALLY INSULATED FROM WAVEGUIDE WALLS THROUGH AN AIRGAP

(75) Inventors: James Stanec, St. Louis, MO (US); Nicholas S Barker, Charlottesville, VA (US)

(73) Assignees: James Stenec, St. Louis, MO (US); Scott Barker, Charlottesville, VA (US)

( * ) Notice: Subject to any disclaimer, the term of this patent is extended or adjusted under 35 U.S.C. 154(b) by 538 days.

(21) Appl. No.: 12/790,300

(22) Filed: May 28, 2010

(65) Prior Publication Data

US 2010/0301973 A1 Dec. 2, 2010

Related U.S. Application Data

(60) Provisional application No. 61/181,873, filed on May 28, 2009.

(51) Int. Cl.
*H01P 1/28* (2006.01)

(52) U.S. Cl.
USPC ..... 333/248; 333/253

(58) Field of Classification Search
USPC ..... 333/248, 253, 232, 233
See application file for complete search history.

(56) References Cited

U.S. PATENT DOCUMENTS 2,543,721 A 2/1951 Collard et al.
2,675,524 A 4/1954 Collard
2,829,352 A 4/1958 Hennies et al.
2,944,234 A 7/1960 De Ronde
3,049,684 A 8/1962 Vaccaro et al.
3,614,518 A * 10/1971 Schmidt ..... 315/5.53
4,216,450 A 8/1980 Linke et al.
5,138,289 A 8/1992 McGrath

OTHER PUBLICATIONS

R. E. Collin, "Foundations for Microwave Engineering (2nd Edition)", 2001 Wiley-IEEE Press.
A. R, Kerr, "An Adjustable Short-Circuit for Millimeter Waveguides", Jul. 1988, National Radio Astronomy Observatory, Charlottesville, Virginia, Electronics Division Internal Report No. 280.
Victor M. Lubecke, Koji Mizuno, and Gabriel M. Rebeiz, "Micromachining for Terahertz Applications", IEEE Transactions on Microwave Theory and Techniques, vol. 46, No. 11, Nov. 1998.
W.R. McGrath, T.M. Weller, and L.P.B. Katehi, "A Novel Noncontacting Waveguide Backshort for Submillimeter Wave Frequencies", J. of IR & MM, vol. 16, No. 1, pp. 237, 1995.
Ville S. Mottonen, Receiver Front-End Circuits and Components for Millimetre and Submillimetre Wavelengths, Helsinki University of Technology Radio Laboratory Publications, Espoo, Apr. 2005, Report S 269.
Charlie H. Smith III, Haiyong Xu, and N. Scott Barker, "Development of a Multi-layer SU-8 Process for Terahertz Frequency Waveguide Blocks", Microwave Symposium Digest, 2005 IEEE MTT-S International, Jun. 12-17, 2005.

(Continued)

*Primary Examiner* — Benny Lee
(74) *Attorney, Agent, or Firm* — Zobrist Law Group; Dale Jensen

(57) ABSTRACT

Certain exemplary embodiments can provide a rectangular waveguide and backshort adapted for using/studying millimeter and/or submillimeter waves. Exemplary sliding shorts can exhibit relatively low loss, relatively smooth phase variation with frequency and movement, and/or relatively good repeatability. Certain exemplary embodiments can resist transmission of power by reflecting substantially all power from an incident signal.

8 Claims, 14 Drawing Sheets

4000

(56) References Cited

OTHER PUBLICATIONS

Thomas M. Weller, Linda P. B. Katehi, and William R. McGrath, "Analysis and Design of a Novel Noncontacting Waveguide Backshort", IEEE Trans. Microwave Theory Tech., vol. 43, pp. 1023-1030, May 1995.

Haiyong Xu, Zhiyang Liu, Charlie H. Smith III, Jeffrey L. Hesler, Bascom S. Deaver, Jr., and Robert M. Weikle II, "A Non-Contacting Tunable Waveguide Backshort for Terahertz Applications", Microwave Symposium Digest, 2006. IEEE MTT-S International, pp. 1919-1922, Jun. 11-16, 2006.

* cited by examiner

WAVEGUIDE BACKSHORT ELECTRICALLY INSULATED FROM WAVEGUIDE WALLS THROUGH AN AIRGAP

CROSS-REFERENCES TO RELATED APPLICATIONS

This application claims priority to, and incorporates by reference herein in its entirety, U.S. Provisional Patent Application Ser. No. 61/181,873, filed May 28, 2009.

SUMMARY

An aspect of an embodiment provides, among other things, sliding backshort designs and integrates them with machining and lithographic micromachining techniques to increase the flexibility of conventional rectangular waveguides for using/studying millimeter and sub-millimeter waves. For instance, a good sliding short should exhibit relatively low loss, relatively smooth phase variation with frequency and movement, and good repeatability. Ideally, for example, a short should substantially prevent transmission of power by reflecting substantially all power from an incident signal.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a rectangular waveguide and backshort adapted for processing, using, and/or studying millimeter and/or submillimeter waves. Exemplary sliding shorts can exhibit relatively low loss, relatively smooth phase variation with frequency and movement, and relatively good repeatability. Certain exemplary embodiments can resist transmission of power by reflecting substantially all power from an incident signal.

Figure 1:
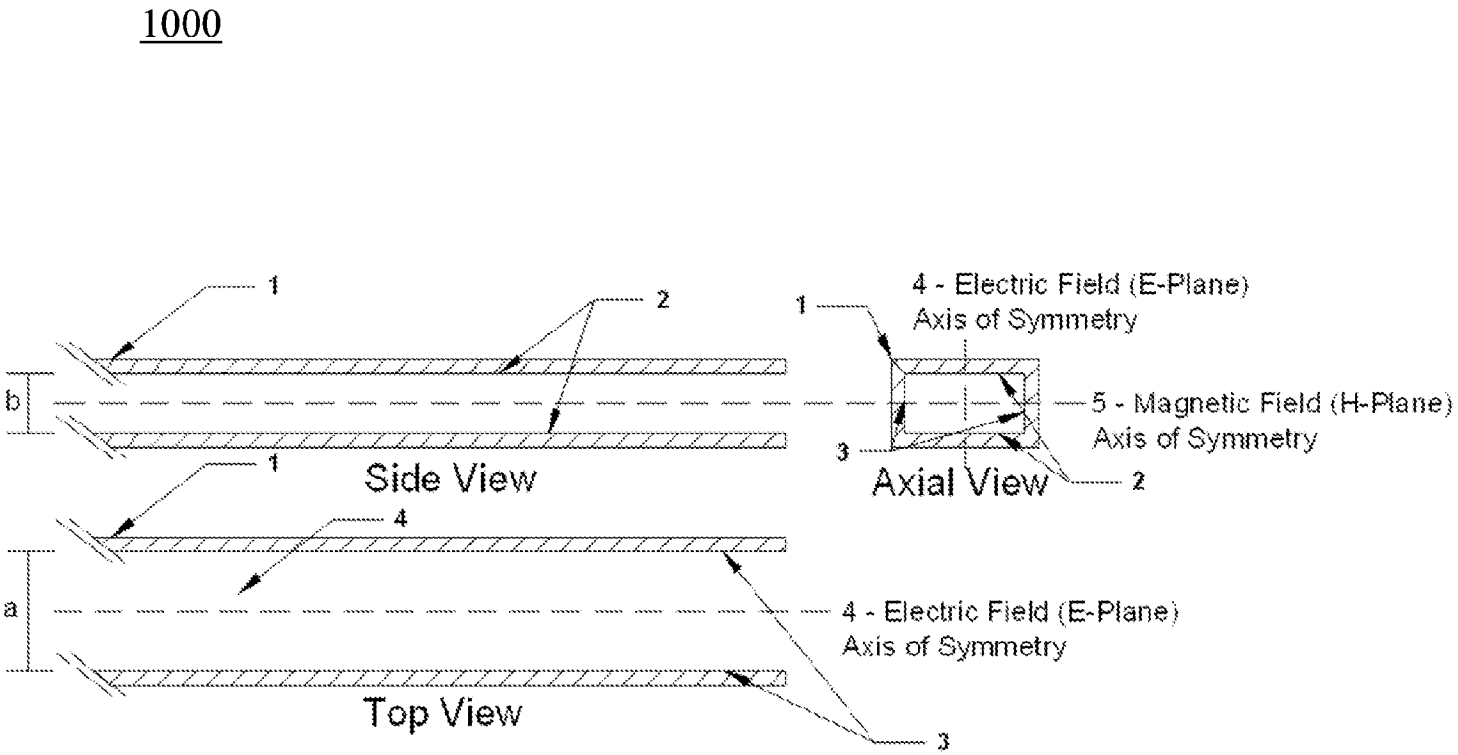
FIG. 1 is a top, side, and axial view of an exemplary embodiment of a system 1000.

FIG. 1 is a top, side, and axial view of an exemplary embodiment of a system 1000, which comprises a rectangular waveguide (1) with cross-section dimensions (a & b). At submillimeter frequencies, rectangular waveguides (see, e.g., FIG. 1) can be used to couple signals into various devices such as oscillators and mixers or into planar circuits such as microstrip and coplanar waveguide (CPW). To provide a transfer of power, certain exemplary embodiments can terminate such waveguides with a short circuit a quarter-wavelength from the coupling structure. Sliding (i.e., tunable) backshorts can be used at these wavelengths because the coupling structure's impedance might not be known and precise fabrication of a waveguide quarter-wave backshort can be difficult. In terms of measurement and calibration, sliding shorts can be useful. Certain exemplary embodiments can provide sliding shorts through E-H tuners, to characterize active terahertz devices. An E-H tuner can use a relatively high VSWR (voltage standing wave ratio) sliding short to match to a relatively large number of impedances. A six-port reflectometer can offer a solution for the increasing demand for high frequency network analyzers; however; much of its calibration relies on having a sliding short that offers acceptable performance across the band on interest. Certain exemplary embodiments provide sliding shorts which exhibit relatively good RF performance for terahertz frequencies.

Figure 2:
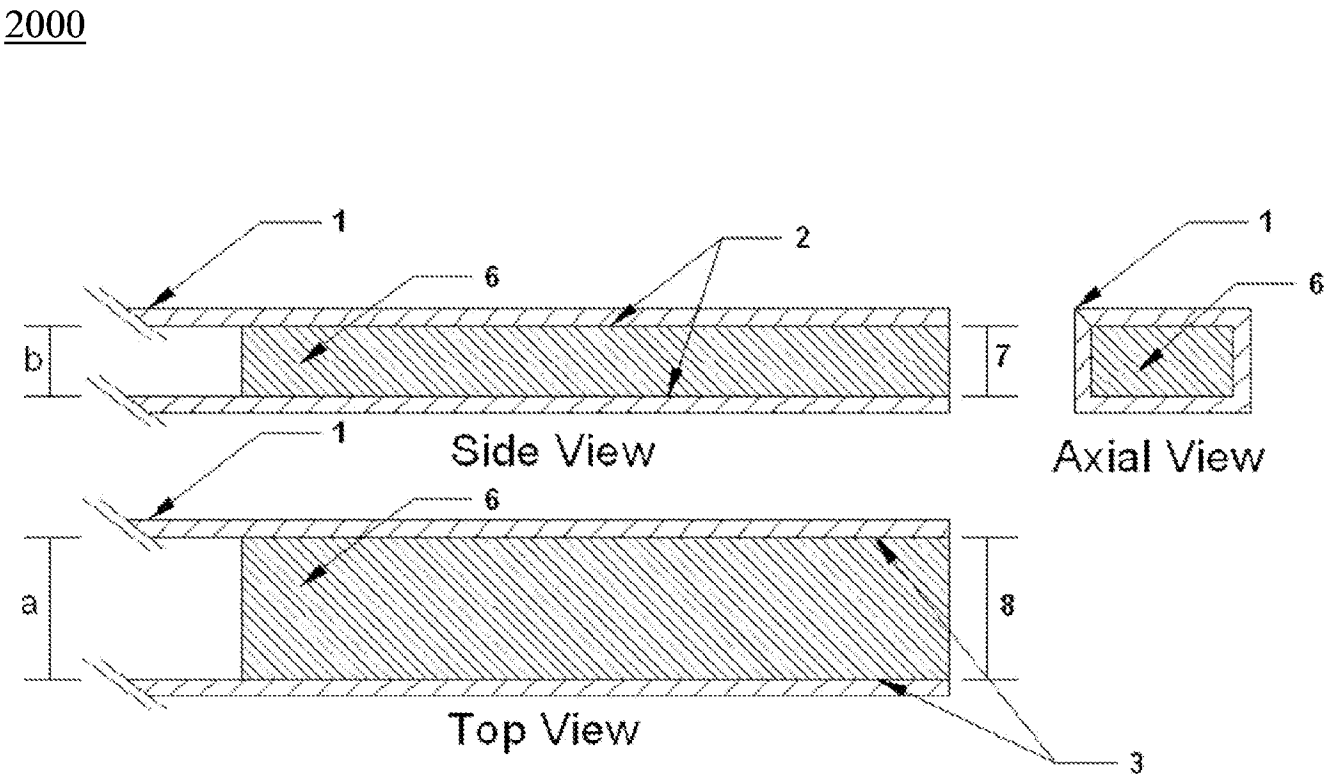
FIG. 2 is a top, side, and axial view of an exemplary embodiment of a system 2000.

FIG. 2 is a top, side, and axial view of an exemplary embodiment of a system 2000, which comprises a contacting rectangular sliding short (6) inside rectangular waveguide (1). The plunger dimensions (7 & 8) are made just slightly smaller than the waveguide dimensions (a & b) to provide a sliding fit. Certain exemplary embodiments provide a sliding short that exhibits relatively low loss, substantially linear phase variation with frequency and movement, and has relatively good repeatability. Sliding shorts can be broken into two categories: contacting and non-contacting. Contacting shorts can be made of a low-loss metal and make direct contact with the waveguide walls. Certain exemplary contacting shorts comprise a rectangular plunger that slides axially in the waveguide (see, e.g., FIG. 2). However, contacting shorts can be plagued by loss associated with power leakage in the gap between the plunger (6) and the waveguide walls (2 & 3), and relatively poor repeatability due to intermittent contact arising from mechanical disturbances and/or frictional wear.

Figure 3:
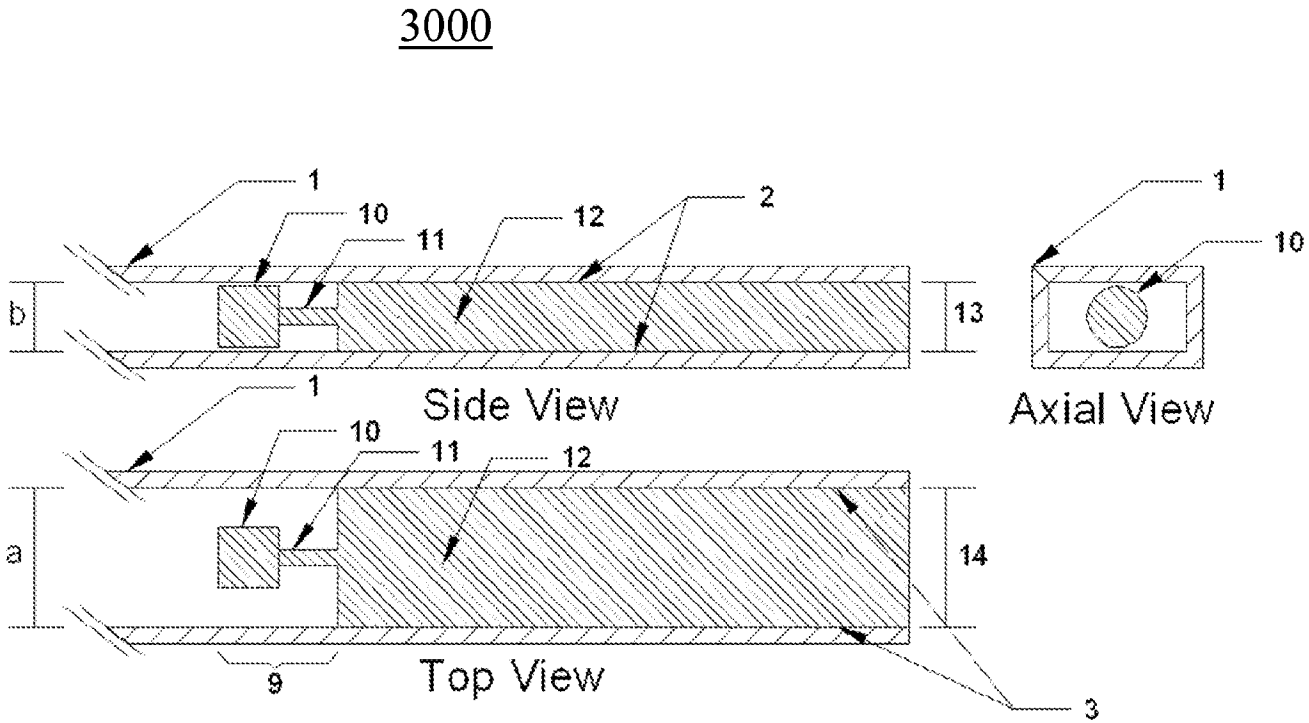
FIG. 3 is a top, side and axial view of an exemplary embodiment of a system 3000.

FIG. 3 is a top, side and axial view of an exemplary embodiment of a system 3000, which comprises dumbbell periodic sliding short inside rectangular waveguide (1). The diameter of the low impedance section (10) is made sufficiently smaller than the waveguide dimension (b) to provide that the larger handle (12) restrains the periodic section (9) from contacting the waveguide broad walls (2). The handle dimensions (13 & 14) are just slightly smaller than the waveguide dimensions (a & b) to provide a sliding fit. The diameter of the high impedance section (11) is made as small as possible given the periodic section (9) is adequately strong. The lengths of both the high and low impedance sections (11 & 10) are approximately a quarter of the guided wavelength ($\lambda_g/4$). Certain exemplary noncontacting shorts can be used for higher frequencies (see, e.g., FIGS. 3-6). Noncontacting shorts can comprise insulated metal periodic sections (9, 16, & 30) of alternating low (10, 17, & 31) and high (11, 18, & 32) impedance (i.e., Z) sections that behave as low-Z/high-Z bandstop filters. To increase repeatability, the low impedance sections (10, 17, & 31) can be either insulated from the waveguide inner broad walls (2) or in the case of the dumbbell periodic geometry, all the walls (2 & 3).

Figure 4:
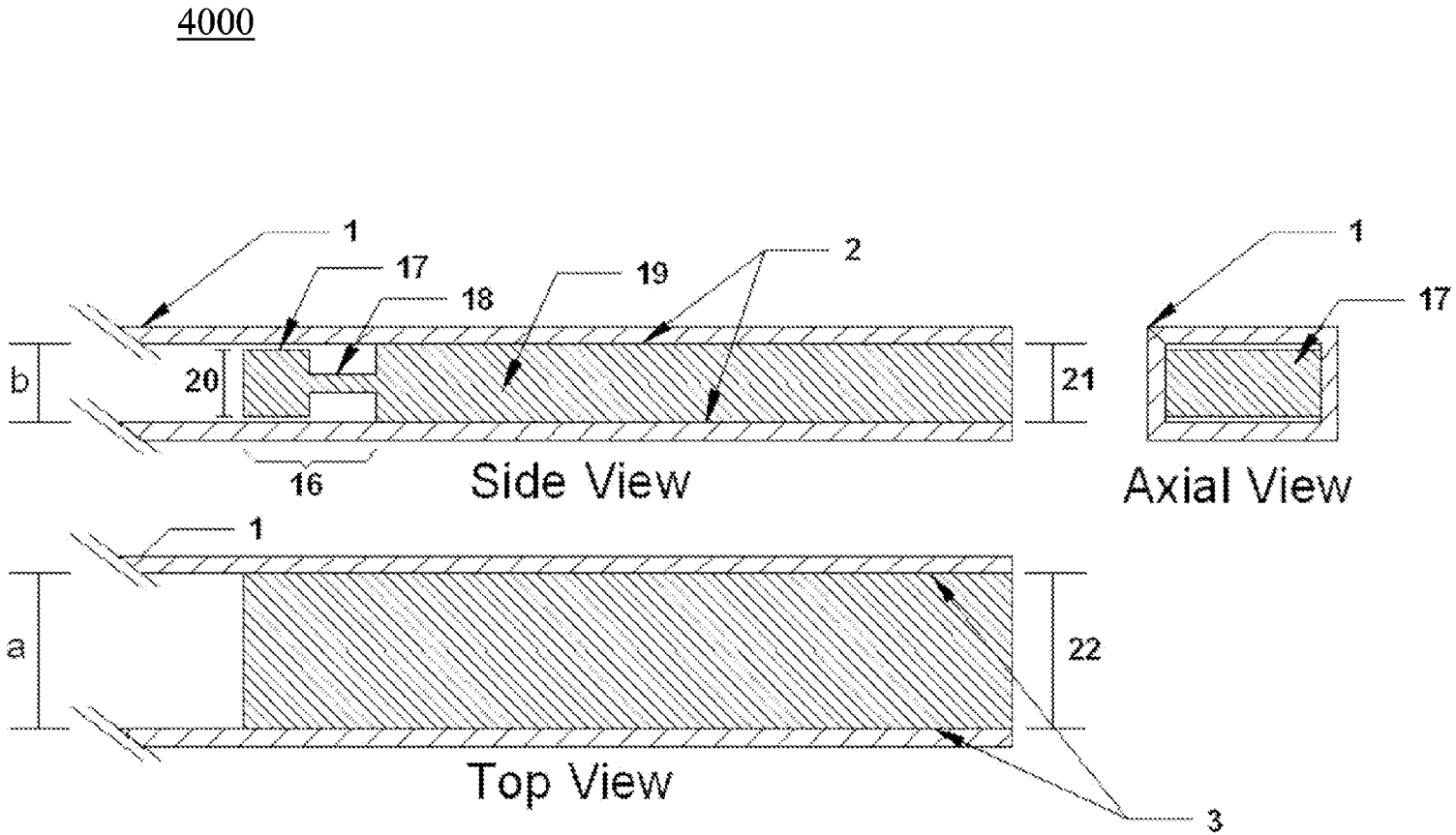
FIG. 4 is a top, side and axial view of an exemplary embodiment of a system 4000.

FIG. 4 is a top, side and axial view of an exemplary embodiment of a system 4000, which comprises an H-plane periodic sliding short inside rectangular waveguide (1). The plunger width (22) is substantially uniform and made just slightly smaller than the waveguide dimension (a) to provide a sliding fit. The height (20) of the low impedance section (17) is made sufficiently smaller than the waveguide dimension (b) to provide that the larger handle (19) restrains the periodic section (16) from contacting the waveguide broad walls (2). The handle dimensions (21 & 22) are just slightly smaller than the waveguide dimensions (a & b) to provide a sliding fit. The high impedance section (18) is aligned along the H-plane axis of symmetry (5—wherein: the H-plane axis of symmetry is illustrated in FIG. 1) and its height is made as small as possible given the periodic section (16) having adequate strength. The lengths of both the high and low impedance sections (18 & 17) are approximately a quarter of the guided wavelength ($\lambda_g/4$).

Figure 5:
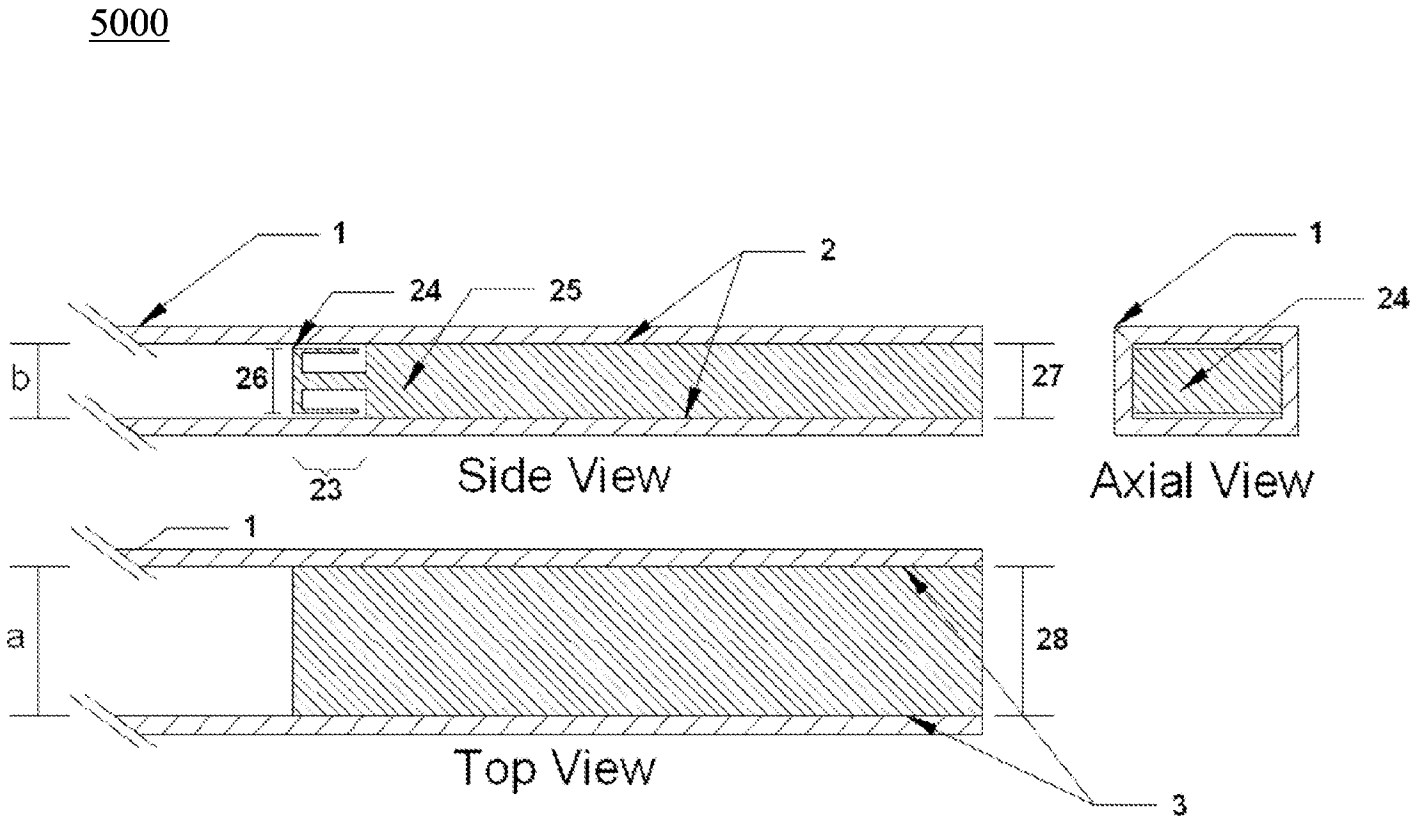
FIG. 5 is a top, side and axial view of an exemplary embodiment of a system 5000.

FIG. 5 is a top, side and axial view of an exemplary embodiment of a system 5000, which comprises an H-plane quarter-wave choke sliding short inside rectangular waveguide (1). The plunger width (28) is substantially uniform and made just slightly smaller than the waveguide dimension (a) to provide a sliding fit; the height (26) of the choke section (24) is made sufficiently smaller than the waveguide dimension (b) to provide that the larger handle (25) prevents the choke section (24) from contacting the waveguide broad walls (2). The handle dimensions (27 & 28) are just slightly smaller than the waveguide dimensions (a & b) to provide a sliding fit. The length of the choke section is approximately a quarter of the guided wavelength ($\lambda_g/4$).

Figure 6:
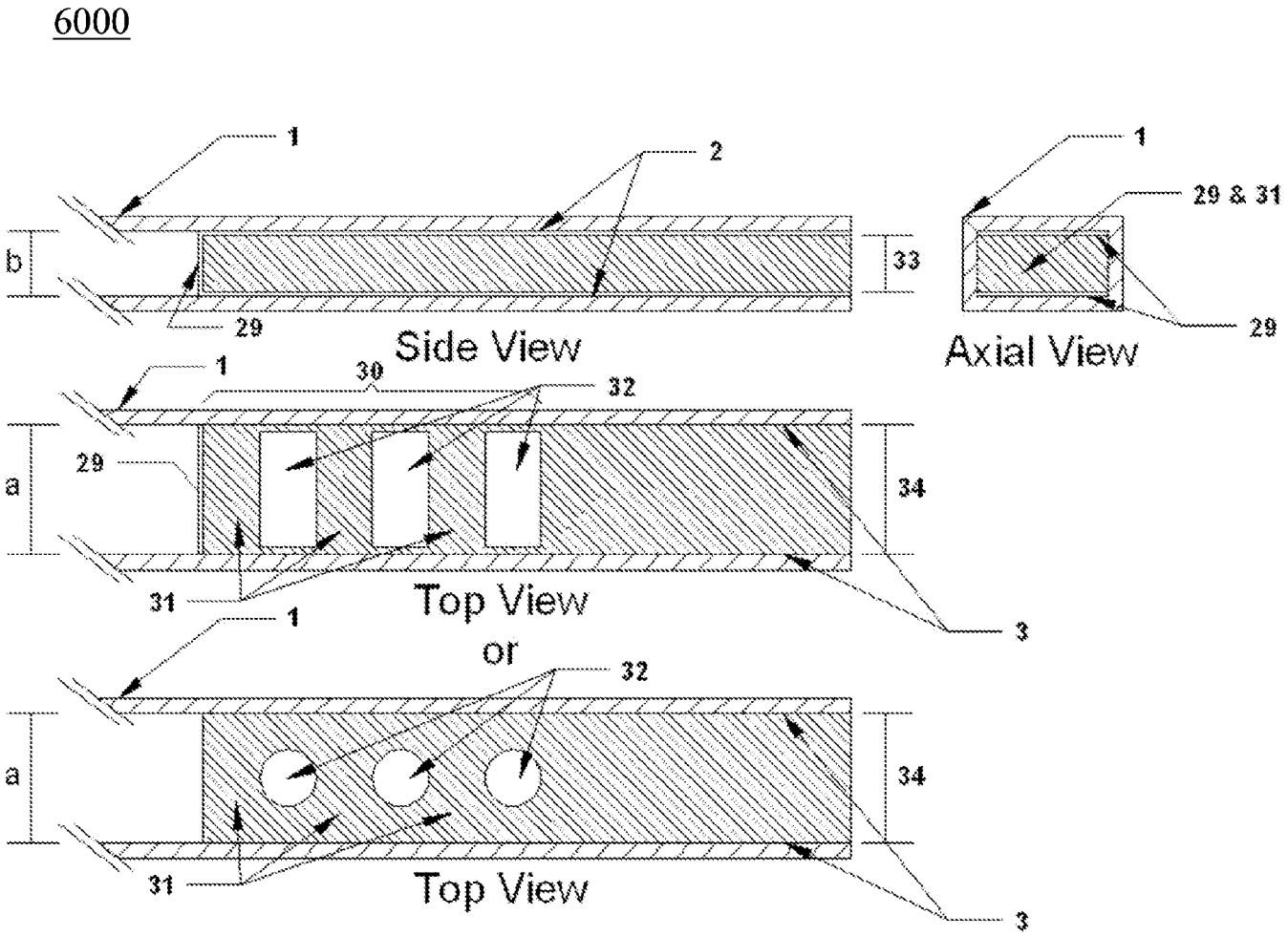
FIG. 6 is a top, side and axial view of an exemplary embodiment of a system 6000.

FIG. 6 is a top, side and axial view of an exemplary embodiment of a system 6000, which comprises an E-plane rectangular/circular hole periodic sliding short inside rectangular waveguide (1). The plunger width (34) is substantially uniform and made just slightly smaller than the waveguide dimension (a) to provide a sliding fit between waveguide side walls (3). The plunger height (33) is substantially uniform and made sufficiently smaller than the waveguide dimension (b) to allow space for a thin insulating film (29) to prevent the plunger from contacting the waveguide broad walls (2). Substantially rectangular or substantially circular holes (32) form the high impedance section of the plunger. The lengths of both the high and low impedance sections (32 & 31) are approximately a quarter of the guided wavelength ($\lambda_g/4$).

Noncontacting periodic plunger designs can comprise a periodic dumbbell design (see, e.g., FIG. 3), an H-plane periodic design (see, e.g., FIG. 4), an H-plane choke design (see, e.g., FIG. 5), and/or E-plane periodic hole plungers (see, e.g., FIG. 6). Certain exemplary noncontacting periodic plungers can be micromachined for terahertz frequencies using SU-8 photoresist. Of these designs, the periodic (16 & 30) in FIGS. 4 & k respectively and choke sections (23) in FIG. 5 can be insulated from the inner waveguide broad walls (2) to prevent erratic phase and magnitude responses. The periodic (16) and choke (23) sections in FIG. 4 and FIG. 5 can be insulated from the inner waveguide broad walls (2) geometrically by attaching them to larger handles (19 & 25) that align those sections in the waveguide (1). The periodic section (30) in FIG. 6 can be insulated from the waveguide broad walls (2) using an insulating film/tape (29). In FIG. 3, the dumbbell periodic section (9) can be insulated from all of the waveguide walls (2 & 3) due to its circular geometry and its larger handle (12). At lower frequencies it is relatively easy to machine these geometries and wrap/coat these plungers with an insulating film; however, in the terahertz spectrum these features can be difficult to attain.

In certain exemplary backshorts of the H-plane low-Z high-Z periodic and the E-plane hole designs, the height of the periodic plunger can be trimmed and/or insulated to avoid the low impedance section of the plunger from contacting with the waveguide (1) inner broad walls (2). In certain exemplary backshorts, contact with the inner sidewalls (3) might not be important and the width of the periodic structure can be kept as close as possible to the waveguide broad wall dimension (a).

Certain exemplary embodiments, where the plunger is insulated from the sidewalls but allowed to contact the top and bottom walls, yield superior performance. The performance of three variations for the rectangular design will be described to explain this phenomena—one rectangular design (FIG. 1), one with a trimmed top and bottom (35) relative to the handle (36) to prevent contact with the waveguide broad walls (2) (FIG. 7), and one with trimmed sides (39) relative to the handle (40) to prevent contact with the waveguide sidewalls (3) (FIG. 8).

Figure 7:
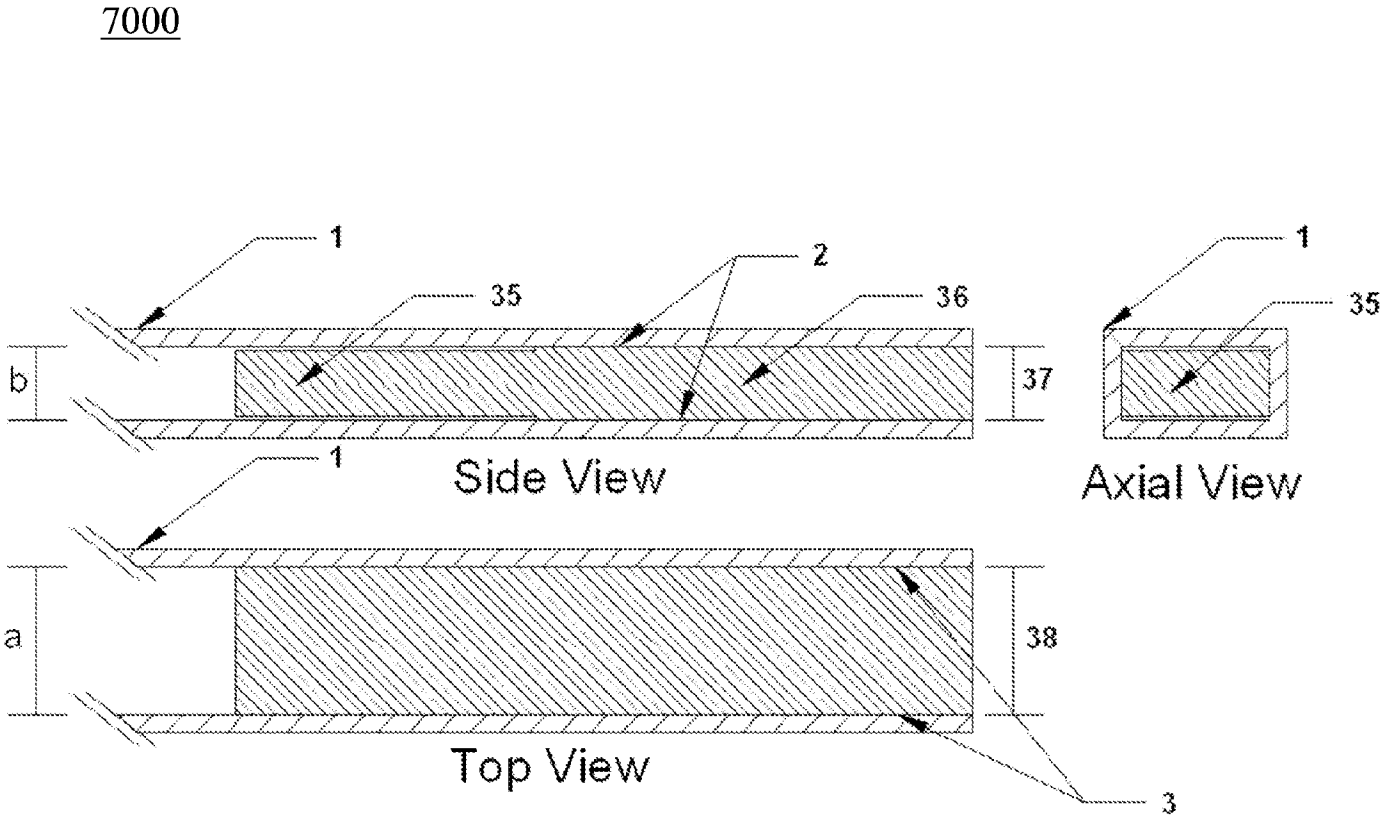
FIG. 7 is a top, side and axial view of an exemplary embodiment of a system 7000.

FIG. 7 is a top, side and axial view of an exemplary embodiment of a system 7000, which comprises a top/bottom trimmed rectangular sliding short inside rectangular waveguide (1). The plunger width (38) is substantially uniform and made just slightly smaller than the waveguide dimension (a) to provide a sliding fit; the height of the trimmed section (35) is made sufficiently smaller than the waveguide dimension (b) to provide that the larger handle (36) substantially prevents the trimmed section (35) from contacting the waveguide broad walls (2). The handle dimensions (37 & 38) are just slightly smaller than the waveguide dimensions (a & b) to provide a sliding fit. In the case of a rectangular plunger with a trimmed top/bottom relative to its handle to prevent broad wall contact but not sidewall contact (FIG. 7). The waveguide/plunger structure behaves as ridged waveguide for the $TE_{01}$ mode. This is because the wide dimension of the plunger (38) must be made slightly smaller than the waveguide broad wall dimension (a) to provide a relatively smooth sliding fit. Because a sliding fit is provided, the plunger will only be in contact with one sidewall (3) at any time thus forming a ridged waveguide structure. Since ridged waveguide is more broadband than rectangular waveguide, the ridged waveguide section attempts to couple the $TE_{10}$ mode into the $TE_{01}$ orientation resulting in a hybrid $TE_{11}$ type of mode. This is consistent with experimental results and simulations obtained via HFSS (High Frequency Structural Simulator—a finite element method solver for electromagnetic structures of Ansoft Corporation of Pittsburgh Pa.). This phenomenon explains certain deep and spurious observed magnitude resonances. The top/bottom trimmed plunger (FIG. 7) creates a resonator for the coupled hybrid mode, where the $TE_{01}$ mode is cutoff on both sides by the handle and the non-ridged rectangular waveguide. Furthermore, resonator's quality factor (Q) changes based on where the plunger contacts the waveguide sidewalls (3).

Figure 8:
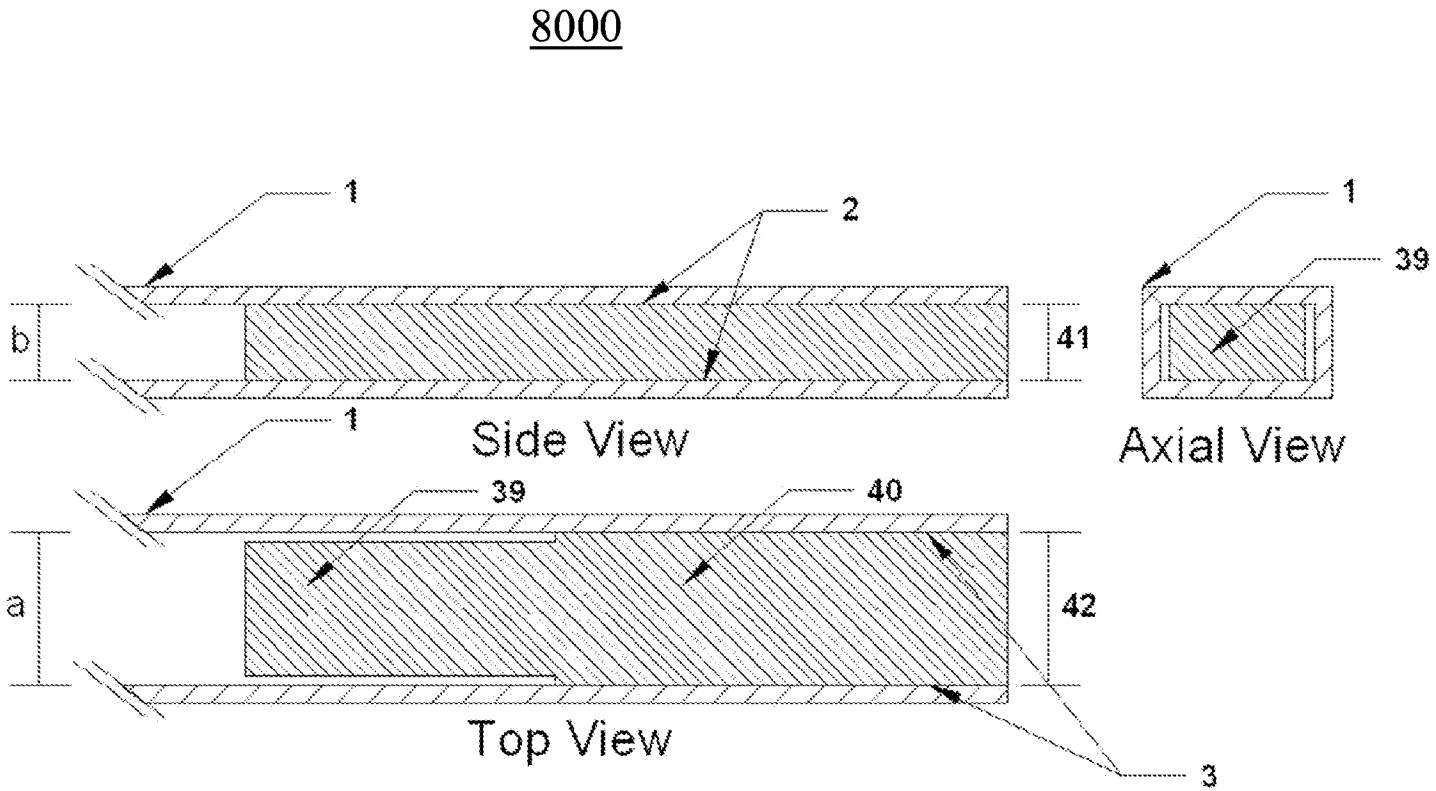
FIG. 8 is a top, side and axial view of an exemplary embodiment of a system 8000.

FIG. 8 is a top, side and axial view of an exemplary embodiment of a system 8000, which comprises a side-trimmed rectangular sliding short inside rectangular waveguide (1). The plunger height (41) is substantially uniform and made just slightly smaller than the waveguide dimension (b) to provide a sliding fit. The width of the trimmed section (39) is made sufficiently smaller than the waveguide dimension (a) to provide that the larger handle (40) substantially prevents the trimmed section (39) from contacting the waveguide sidewalls (3). The handle dimensions (41 & 42) are just slightly smaller than the waveguide dimensions (a & b) to provide a sliding fit. In regards to the side-trimmed plunger, which is adapted to substantially avoid contact with the waveguide sidewalls (3) but not with the broad walls (2) (FIG. 8), this geometry inhibits any coupling of $TE_{10}$ mode into other cutoff modes and thereby gives rise to a plunger with superior performance that can also be relatively resilient to mechanical disturbances.

Furthermore, the resilience of the side-trimmed plunger (FIG. 8) to varying contact arises from the direction that current flows along the waveguide walls (2 & 3). In exemplary rectangular waveguides, currents on the top and bottom waveguide walls (2) travel in opposite directions while sidewall (3) currents flow in the same direction. When the side trimmed plunger (FIG. 8) randomly changes contact between the top and bottom walls the current across the front face of the plunger will not change directions which means that the magnetic field (B) and electric field (E) will have the same orientation and therefore will result in a plunger whose phase response is relatively impervious to changing broad wall contact. Conversely, when the top/bottom trimmed plunger (FIG. 7) contacts the inner waveguide sidewalls (3), the current will flow off the sidewall and diagonally across the front face of the side trimmed plunger. When the plunger shifts and makes contact on the opposite sidewall, the currents will again run off the sidewall and flow diagonally across the front face of the plunger, but because sidewall currents flow in the same direction the current on the plungers face will flow in the opposite direction then it had traveled when the plunger had contacted the opposing sidewall. Therefore, the two resulting B and E-fields will be approximately 180° out of phase which contributes to the top/bottom trimmed plunger's (FIG. 7) relatively erratic phase response.

Figure 9:
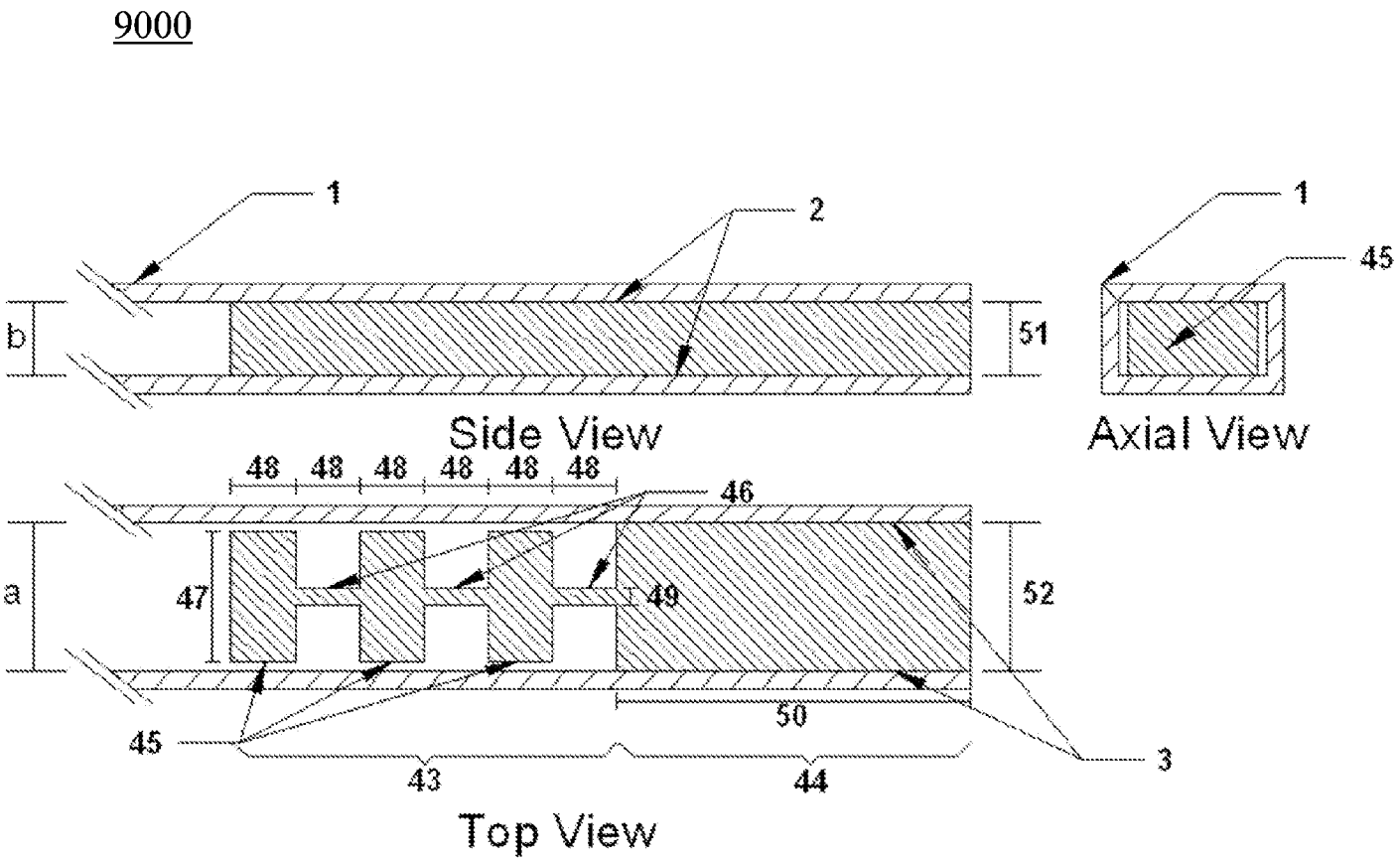
FIG. 9 is a top, side and axial view of an exemplary embodiment of a system 9000, which comprises a rectangular waveguide.

Certain exemplary embodiments (e.g., FIG. 9) can have a periodic design in which high impedance sections (46) are rotated to be aligned with the E-plane axis of symmetry (4—wherein: the E-plane axis of symmetry is illustrated in FIG. 1) which can provide easier fabrication for higher frequencies using a ultraviolet ("UV") Lithographie, Galvanoformung, Abformung ("LIGA") (a German acronym meaning Lithography, Electroplating, and Molding) electroforming process.

At millimeter wavelength the periodic backshort (e.g., FIG. 9) can be conventionally machined (i.e. milled) from a high conductivity metal such as gold, aluminum, or copper to fit into a rectangular waveguide (1). The short comprises alternating low (45)—high impedance (46) sections whose lengths are approximately a quarter of the guided wavelength ($\lambda_g/4$) (48). The alternating low-high impedance sections (43) can be terminated with a long rectangular handle section (44).

The rectangular handle's (44) cross-sectional dimensions (51) and (52) are slightly less than the interior dimensions (a) and (b) of the waveguide (1) to allow the short to freely slide within the confines of the guide. Furthermore, the handle length (50) is long enough to substantially prevent the low impedance sections (45) of the short from contacting the inner sidewalls (3) of the rectangular waveguide (1). The low impedance sections (45) comprise rectangular blocks whose heights (51) are only slightly less than that of the interior guide (b) such that the short can slide freely within the guide (1). The width (47) can be made to be less than that of the guide's broad wall dimension (a) to substantially prevent the low impedance sections (45) from contacting with the waveguide sidewalls (3) if the short becomes oriented diagonally along the electric field's axis of symmetry (4). For example, an exemplary X-band design can comprise low impedance sections that are approximately 88% of the rectangular guide's broad wall dimension (a).

The high impedance sections (46) can be oriented along the axis of symmetry of the electric field (4) parallel to the narrow walls (3) of the rectangular guide (1). The high impedance sections' widths (49), along the broad dimension (a) of the waveguide (1), are kept to an approximate minimum provided it maintains the necessary structural strength for the short. Its height (51) is slightly less than the dimension of the waveguide sidewalls (b) such that the short can slide freely within the rectangular waveguide (1). Any number of alternating low-high impedance sections may be used.

Figure 10:
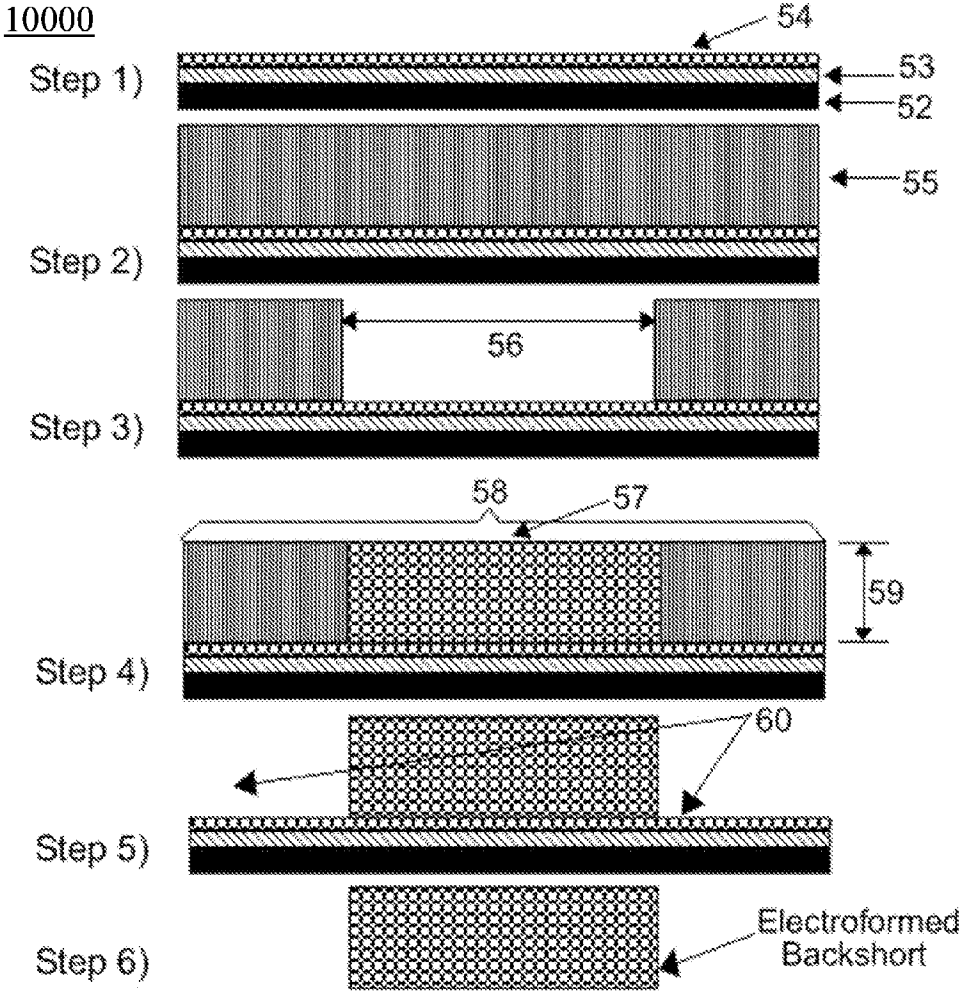
FIG. 10 is a top, side and axial view of an exemplary embodiment of a system 10000, which is illustrative of a process for fabricating a system such as the system 9000 of FIG. 9 for submillimeter and terahertz frequencies.

At submillimeter wavelengths the millimeter geometry (FIG. 9) can be scaled to smaller dimensions; however, fabrication can be accomplished using thick photoresist and electroplating technology (see e.g., FIG. 10). In step 1, a sacrificial layer (53), composed of some substance which can be removed without damaging the backshort material (57), can be deposited onto a substrate (52). Next, a thin seed layer (54) of the high conductivity metal, which will form the backshort, can be deposited. In step 2, a relatively thick film of photoresist (55), slightly larger than the rectangular guides narrow wall dimension (3) can be applied to the seed layer (54), the photoresist (55) can be exposed and developed in step 3 to create a mold (56) of the top view shown in FIG. 9. In step 4, the high conductivity metal composing the seed layer can be electroplated into the mold (56) and the face of the photoresist/backshort composite structure (58) can be lapped to dimensions (59) slightly less than that of the rectangular guide's height (b) such that the short can slide relatively freely in the guide. The remaining photoresist (60) can be removed (shown in step 5) and the short can be released by removing the seed and sacrificial layers of step 1, as shown in step 6.

Certain exemplary embodiments (e.g., FIG. 9) can have a geometry wherein the high impedance sections can be aligned with and parallel to the electric field axis of symmetry (4) and parallel to the waveguide sidewalls (3).

Certain exemplary embodiments (e.g., FIG. 9) can have a geometry that is relatively easy to fabricate for submillimeter and terahertz frequencies using the UV LIGA process. Certain exemplary embodiments provide backshorts adapted for use at frequencies above W-band (75-110 GHz).

Preventing contact between the waveguide sidewalls (3) and the periodic section of the plunger can improve performance and repeatability. Whereas, preventing contact between the waveguide broad walls (2) and the periodic section of the plunger can degrade performance and repeatability. This improvement is not limited to the embodiment illustrated in FIG. 9, but also holds true for plunger designs such as those illustrated in FIGS. 2, 4, 5, 6, and other designs that substantially avoid contact with waveguide broad walls (2) but substantially permit sidewall contact (3).

In short, in an embodiment it shall be provided, but not limited thereto, a way to fabricate a novel rectangular waveguide tuning structure (backshort) for RF and microwave radiation with relative ease. The design has applications comprising all fields that use and/or require tuning of RF and microwave radiation. Applications can comprise biological imaging, chemical and biological agent detection, quality control, atmospheric science, and/or radio astronomy, etc. Biological imaging applications can comprise soft tissue imaging (low water content) based on relative density, non-ionizing radiation (relatively innocuous to tissue), and/or surface cancer screening, etc. Chemical and biological agent detection applications can comprise security screening applications (less invasive, lower health risk), and/or pharmaceutical industry applications (drug compositional analysis), etc. Radio astronomy applications can comprise submillimeter and FIR applications adapted to account for approximately ½ of galaxies observed brightness; applications to determine composition of interstellar medium (e.g., stars' birthplaces); and/or high altitude, dry climate, and/or satellite telescopes; etc. Certain exemplary designs offer a significant impact at submillimeter wavelength and/or terahertz frequencies.

Figure 11:
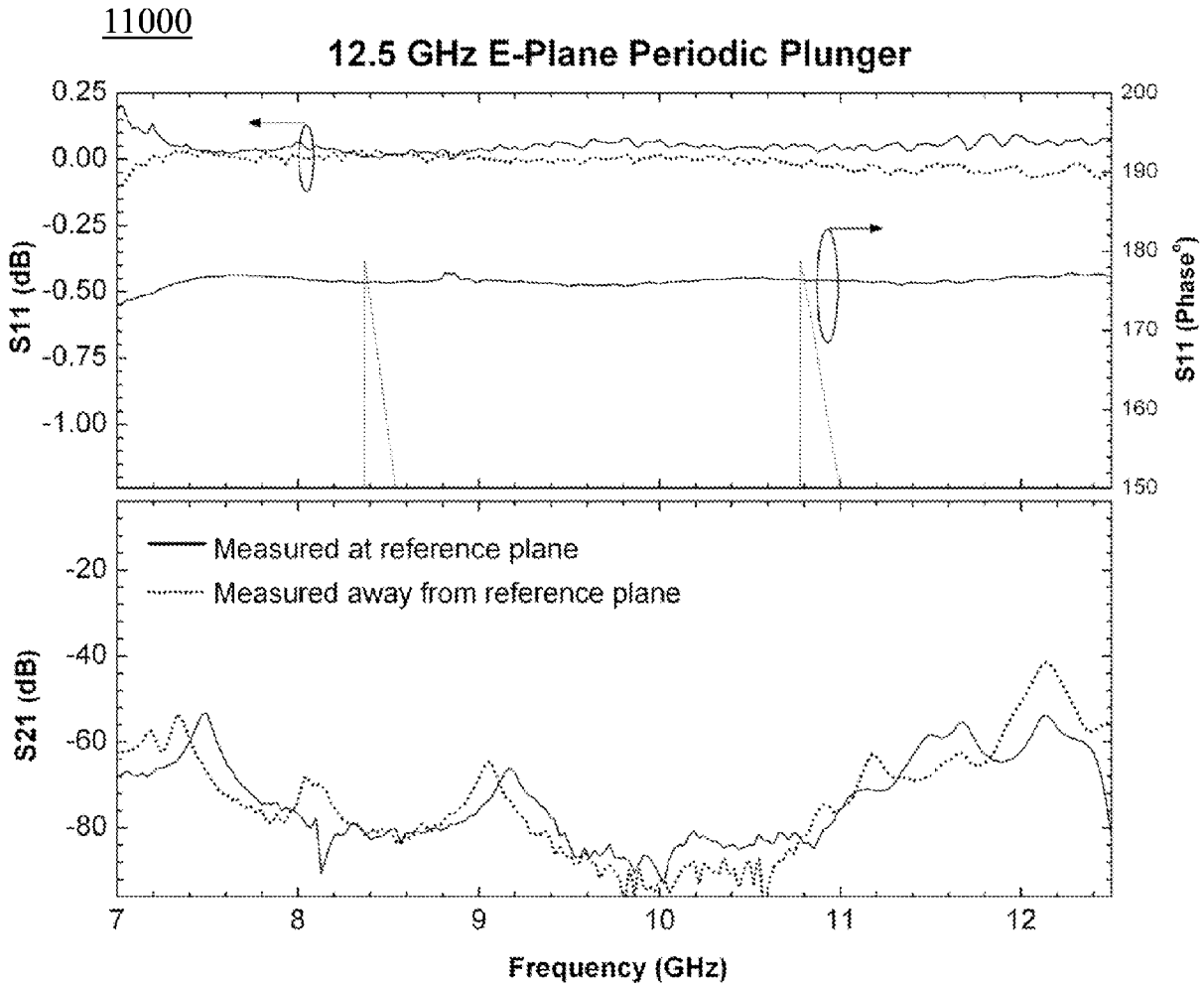
FIG. 11 is a graph set 11000 of tests of an exemplary E-plane periodic plunger (system 9000)

FIG. 11 is a graph set 11000 of tests of an exemplary E-plane periodic plunger (system 9000) designed for X-band (7-12.5 GHz) shows less than 0.10 dB return loss and linear phase across the band.

Figure 12:
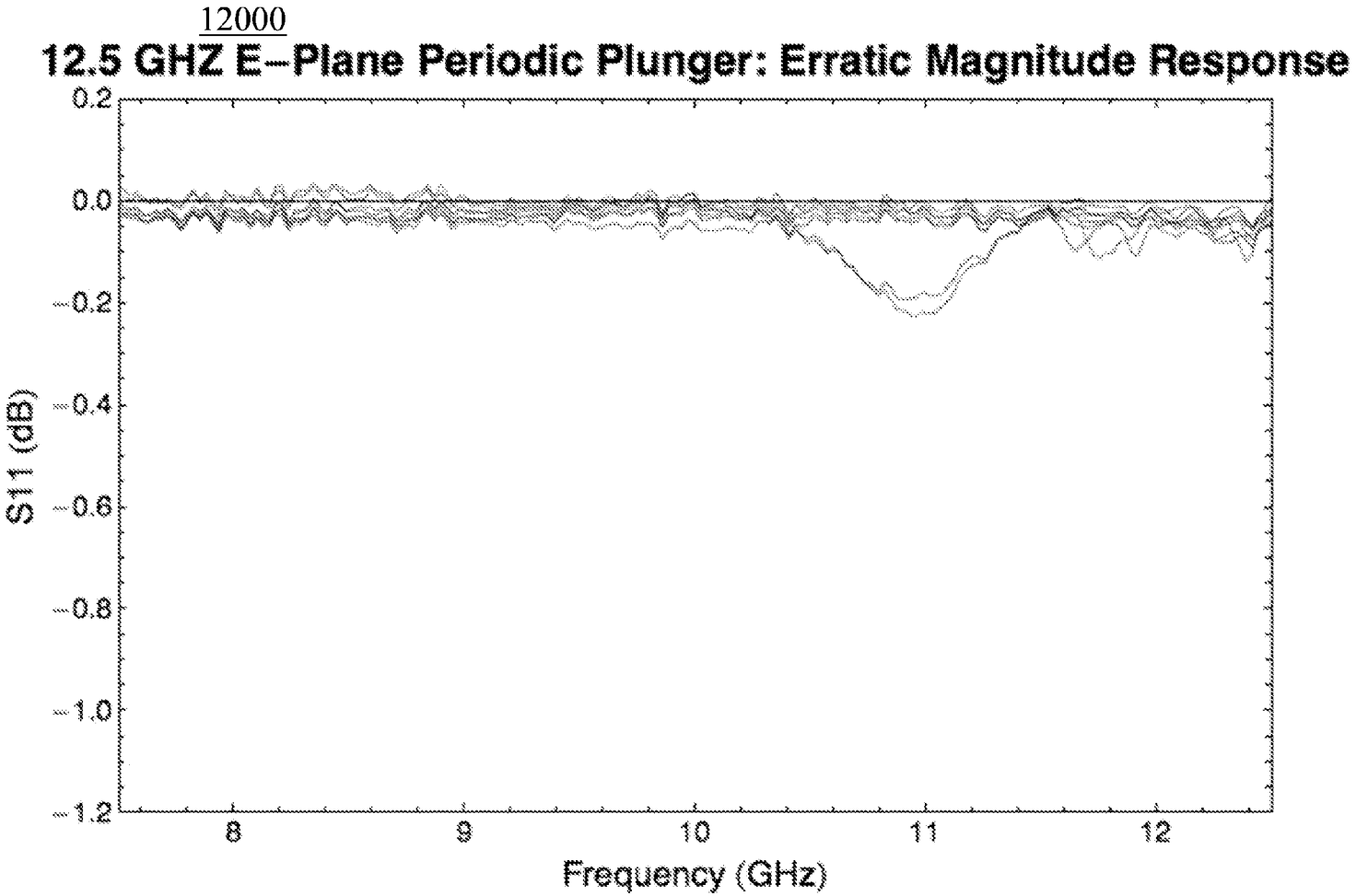
FIG. 12 is a graph 12000 of tests in which an exemplary E-plane periodic plunger (system 9000) demonstrated resistance to mechanical disturbances and vibrations.

FIG. 12 is a graph 12000 of tests in which an exemplary E-plane periodic plunger (system 9000) demonstrated a substantially linear phase across the band. Certain exemplary embodiments designed for X-band (7-12.5 GHz) show less than approximately 0.25 dB return loss when subjected to mechanical disturbances and/or vibration.

Figure 13:
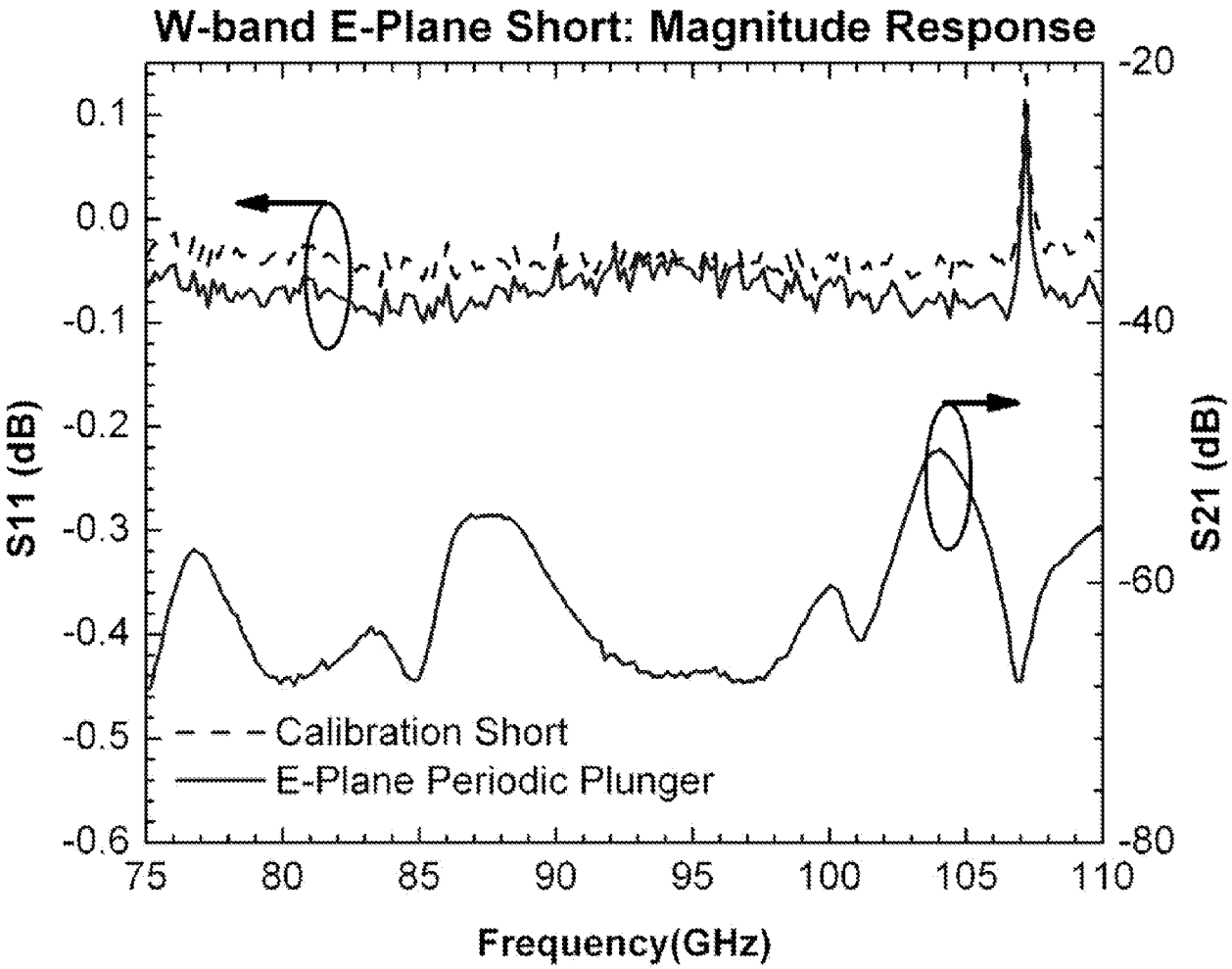
FIG. 13 is an exemplary magnitude plot of E-plane periodic sliding short (system 9000) in a WR-10 waveguide section.

FIG. 13 is an exemplary magnitude plot of E-plane periodic sliding short (system 9000) in a WR-3 waveguide section. Certain exemplary embodiments designed for W-band (75-110 GHz) show less than approximately 0.101 dB return loss and better than 50 dB insertion loss.

Figure 14:
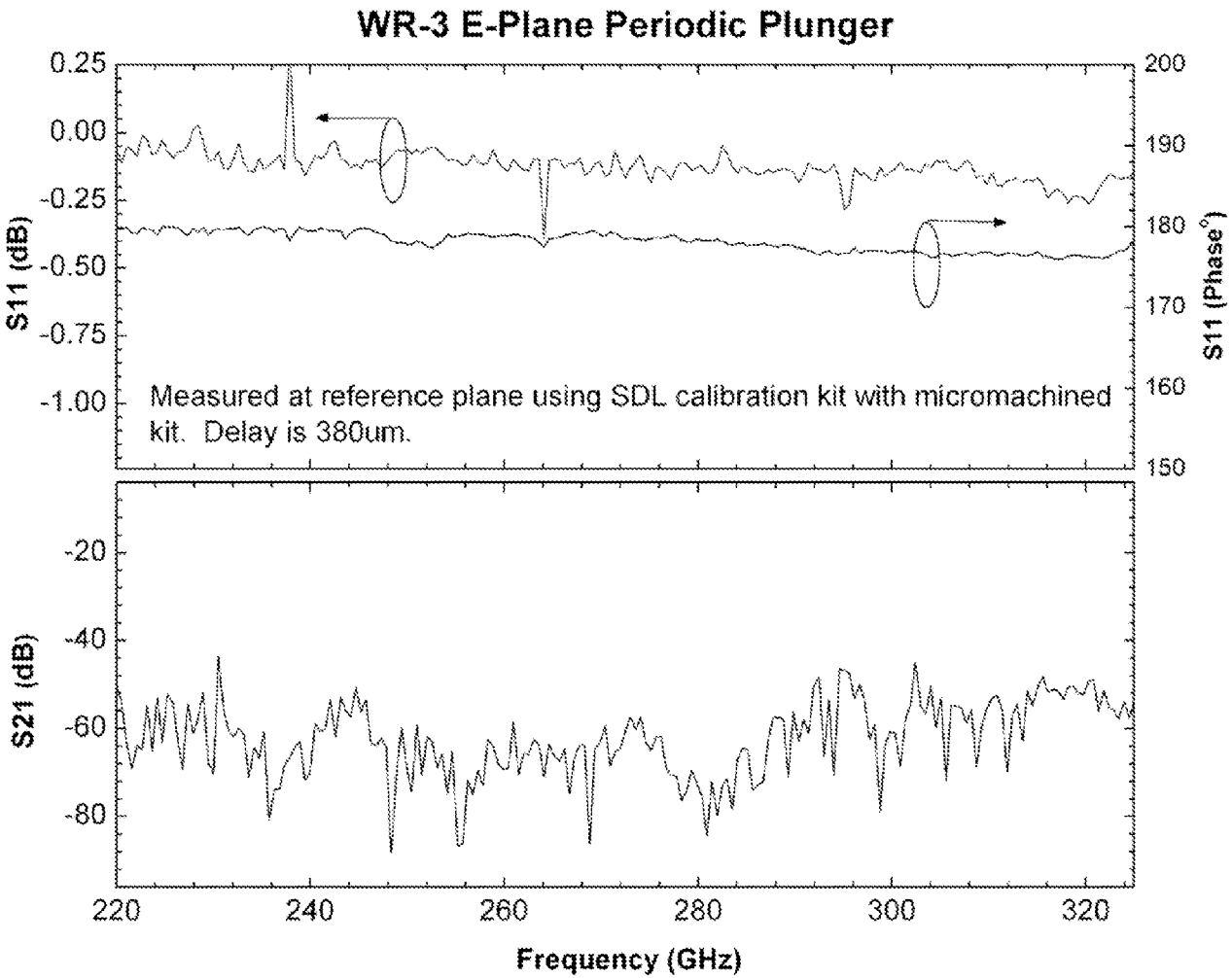
FIG. 14 is an exemplary phase plot of E-plane periodic sliding short (system 9000) in a WR-3 waveguide section.

FIG. 14 is an exemplary phase plot of E-plane periodic sliding short (system 9000) in a WR-3 waveguide section. Certain exemplary embodiments designed for WR-3 band (220-325 GHz) show less than approximately 0.25 dB return loss, better than approximately 45 dB insertion loss, and substantially linear phase across the band.

Certain exemplary embodiments provide a system comprising a waveguide. The waveguide can comprise a first sidewall, a second sidewall, a first broad wall and a second broad wall. The first sidewall can be substantially parallel to the second sidewall. The first broad wall can be substantially parallel to the second broad wall. The system can comprise a backshort. The backshort can comprise a conductive metal. The backshort can comprise a plurality of low impedance portions. Each of the plurality of low impedance portions can be aligned along a respective longitudinal axis, wherein each longitudinal axis of each of the plurality of low impedance portions can be substantially parallel. Each of the low impedance portions can have a length measured along the longitudinal axis. The length can be less than approximately 1 millimeter. In certain operative embodiments, the backshort can be adapted to exhibit a return loss better than 0.101 dB across W-band (75-110 GHz) and/or 0.25 dB across WR-3 band (220-325 GHz). When operatively installed in the waveguide:

the backshort can be substantially electrically coupled to each of said first broad wall and said second broad wall via substantial contact between the backshort and one or more of the first broad wall and the second broad wall; and/or the backshort can be substantially electrically insulated to each of the first sidewall and the second sidewall via a defined air gap between the backshort and each of the first sidewall and the second sidewall.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof.

adapted to—made suitable or fit for a specific use or situation.

adapter—a device used to effect operative compatibility between different parts of one or more pieces of an apparatus or system.

and/or—either in conjunction with or in alternative to.

apparatus—an appliance or device for a particular purpose.

apply—to lay or spread on.

aspect ratio—a ratio of a width of an object to its length or height.

associate—to join, connect together, and/or relate.

backshort—a device and/or system adapted to cause a substantial short circuit in a waveguide.

better than—lower in magnitude.

broad wall—one of an opposing pair of walls of a four-walled substantially rectangular waveguide; a section of the waveguide taken substantially perpendicular to a primary axis of travel of an electromagnetic wave in the waveguide defining an opposing pair of sidewalls and an opposing pair of broad walls, the broad walls having a greater dimension in the cross section than the sidewalls, when the waveguide is operatively coupled to an electromagnetic wave of $TE_{10}$ orientation, each broad wall is substantially parallel to a magnetic field (H-Plane) axis of symmetry of electromagnetic waves directed by the waveguide.

can—is capable of, in at least some embodiments.

cause—to produce an effect.

circuit—an electrically conductive pathway and/or a communications connection established across two or more switching devices comprised by a network and between corresponding end systems connected to, but not comprised by the network.

comprising—including but not limited to.

configure—to make suitable or fit for a specific use or situation.

connect—to join or fasten together.

convert—to transform, adapt, and/or change.

couple—to join, connect, and/or link.

coupleable—capable of being joined, connected, and/or linked together.

create—to bring into being.

damage—to cause harm.

define—to establish the outline, form, or structure of.

deposit—to precipitate a substance upon a surface.

determine—to obtain, calculate, decide, deduce, and/or ascertain.

develop—to treat with chemicals so as to cause a change in a surface of a substance.

device—a machine, manufacture, and/or collection thereof.

electrically—relating to a flow of electrons through a conductive medium.

electrically conductive—a material having an electrical conductivity measured in siemens per meter.

electroplate—to plate or coat with a metal by electrolysis.

E-plane quarter-wave rectangular/circular hole periodic sliding short—a backshort comprising a plurality of high and low impedance sections, the high impedance section having a length that is approximately one quarter of the guided wavelength, the low impedance section having a length that is approximately one quarter of the guided wavelength, each of the plurality of high impedance sections defining a substantially cylindrical or rectangular solid air pocket the backshort comprising electrically conductive material.

expose—to subject, as to the action of something.

face—a surface of an object.

film—a thin layer.

generate—to create, produce, give rise to, and/or bring into existence.

guide wavelength—wavelength of electromagnetic energy conducted in a waveguide; guide wavelength for all air-filled guides is always longer than the corresponding free-space wavelength.

H-plane quarter-wave choke sliding short—a backshort comprising a handle and a choke section, the handle having a length that is greater than a length of the choke section, the handle coupled to the choke section via a slab of electrically conductive material, the choke section comprising a front panel having a substantially planar front face and two substantially planar edge panels, the planar edge panels having a length that is approximately one quarter of the guided wavelength, the front face of the front panel substantially perpendicular to each of the substantially planar edge panels, the handle and the choke section also comprising the electrically conductive material.

H-plane quarter-wave periodic sliding short—a backshort comprising a handle, a high impedance section, and a low impedance section, the handle having a length that is greater than a length of the low impedance section, the high impedance section having a length that is approximately one quarter of the guided wavelength, the low impedance section having a length that is approximately one quarter of the guided wavelength, the handle coupled to the low impedance section via a high impedance slab of electrically conductive material, the slab of electrically conductive material having a thickness less than a thickness of the handle and less than the thickness of the plunger, the handle and the low impedance section also comprising the electrically conductive material.

initialize—to prepare something for use and/or some future event.

install—to connect or set in position and prepare for use.

insulate—to cover, line, and/or separate with a material adapted to reduce a passage, transfer, and/or leakage of electricity.

lap—to machine via rubbing two surfaces together with an abrasive between the two surfaces.

longitudinal axis—an imaginary line through an object or portion of an object, along a largest dimension of the object or portion of the object, passing through a center of gravity of the object or portion of the object.

low impedance section—a portion of a backshort having an electrical impedance which is less than 25 percent of a high impedance section of the backshort.

may—is allowed and/or permitted to, in at least some embodiments.

method—a process, procedure, and/or collection of related activities for accomplishing something.

mold—a hollow form adapted to give a particular shape to a fluid or plastic substance.

parallel—being approximately an equal distance apart everywhere.

periodic plunger—a waveguide backshort adapted to be slidably adjusted in the waveguide, having a plurality of alternating low and high impedance sections, each high impedance section having a length that is approximately one quarter of the guided wavelength, each low impedance section having a length that is approximately one quarter of the guided wavelength.

photoresist—a photosensitive liquid polymer, adapted to be used in photolithography.

plasma etch—to remove material from and object via shooting (in pulses) a high-speed stream of glow discharge (plasma) of an appropriate gas mixture at the object.

plurality—the state of being plural and/or more than one.

predetermined—established in advance.

probability—a quantitative representation of a likelihood of an occurrence.

provide—to furnish, supply, give, and/or make available.

receive—to get as a signal, take, acquire, and/or obtain.

recommend—to suggest, praise, commend, and/or endorse.

rectangular—shaped substantially like a rectangle.

rectangular sliding short—a backshort having a substantially uniform rectangular cross-section over its entire length.

repeatedly—again and again; repetitively.

return loss—a loss of signal power resulting from reflection caused at a discontinuity in an electrical conductor.

sacrificial layer—a thickness of some material laid on or spread over a surface that is adapted to be removed.

seed layer—a thickness of some material laid on or spread over a surface that is adapted to bond to additional material deposited thereon.

set—a related plurality.

sidewall—one of an opposing pair of walls of a four-walled substantially rectangular waveguide; a section of the waveguide taken substantially perpendicular to a primary axis of travel of an electromagnetic wave in the waveguide defining an opposing pair of sidewalls and an opposing pair of broad walls, the broad walls having a greater dimension in the cross section than the sidewalls, when the waveguide is operatively coupled to an electromagnetic wave of $TE_{10}$ orientation, each sidewall is substantially parallel to an electric field (E-Plane) axis of symmetry of electromagnetic waves directed by the waveguide.

soak—to lie in a liquid substantially—to a great extent or degree.

substrate—a supporting material on which a circuit is formed or fabricated.

support—to bear the weight of, especially from below.

system—a collection of mechanisms, devices, machines, articles of manufacture, processes, data, and/or instructions, the collection designed to perform one or more specific functions.

transmit—to send as a signal, provide, furnish, and/or supply.

via—by way of and/or utilizing.

waveguide—a conduit adapted for use as a conductor or directional transmitter of an electromagnetic wave.

weight—a value indicative of importance.

wet etch—to chemically remove layers from a surface via use of a liquid.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a waveguide, said waveguide comprising a first sidewall, a second sidewall, a first broad wall and a second broad wall, said first sidewall substantially parallel to said second sidewall, said first broad wall substantially parallel to said second broad wall; and a backshort, said backshort comprising a conductive metal, when operatively installed in said waveguide:

said backshort substantially electrically coupled, without using coiled wires, to each of said first broad wall and said second broad wall via substantial contact between said backshort and each of said first broad wall and said second broad wall; and said backshort substantially electrically insulated to each of said first sidewall and said second sidewall via a defined air gap between said backshort and each of said first sidewall and said second sidewall, said air gap maintained without using bearings.

2. The system of claim 1, wherein:

when operatively coupled, said system is adapted to exhibit a return loss better than approximately 0.101 decibels across W-band (75-110 Gigahertz) and better than approximately 0.25 decibels across WR-3 band (220-325 Gigahertz).

3. The system of claim 1, wherein:

said backshort is a rectangular sliding short.

4. The system of claim 1, wherein:

said backshort is an H-plane quarter-wave periodic sliding short.

5. The system of claim 1, wherein:

said backshort is an H-plane quarter-wave choke sliding short.

6. The system of claim 1, wherein:

said backshort is an E-plane quarter-wave rectangular/circular hole periodic sliding short.

7. The system of claim 1, wherein:

said backshort comprises a plurality of low impedance portions, and a plurality of high impedance portions alternating with said plurality of low impedance portions, each of said plurality of low impedance portions being aligned along a respective longitudinal axis, wherein each longitudinal axis of each of said plurality of low impedance portions are substantially parallel, each of said low impedance portions having a length measured along said longitudinal axis, each said length less than approximately 1 millimeter.

8. A device comprising:

a backshort comprising a conductive metal, said backshort comprising a plurality of low impedance portions, each of said plurality of low impedance portions being aligned along a respective longitudinal axis, wherein each longitudinal axis of each of said plurality of low impedance portions are substantially parallel, each of said low impedance portions having a length measured along said longitudinal axis, each said length less than approximately 1 millimeter, in an operative embodiment, said backshort adapted to exhibit a return loss better than 0.101 dB across W-band (75-110 GHz) and 0.25 dB across WR-3 band (220-325 GHz).

* * * * *